US006183147B1

(12) United States Patent
Kimura et al.

(10) Patent No.: US 6,183,147 B1
(45) Date of Patent: Feb. 6, 2001

(54) PROCESS SOLUTION SUPPLY SYSTEM, SUBSTRATE PROCESSING APPARATUS EMPLOYING THE SYSTEM, AND INTERMEDIATE STORAGE MECHANISM EMPLOYED IN THE SYSTEM

(75) Inventors: Yoshio Kimura; Takahiro Okubo, both of Kikuchi-gun (JP)

(73) Assignee: Tokyo Electron Limited (JP)

( * ) Notice: Under 35 U.S.C. 154(b), the term of this patent shall be extended for 0 days.

(21) Appl. No.: 09/312,581

(22) Filed: May 14, 1999

(30) Foreign Application Priority Data

Jun. 15, 1998 (JP) ..... 10-183325

(51) Int. Cl.[7] ..... G03D 5/00
(52) U.S. Cl. ..... 396/611; 396/626; 396/627
(58) Field of Search ..... 396/604, 611, 396/626, 627; 118/52, 320, 325, 712, 319; 134/2, 3, 153, 157, 902

(56) References Cited

U.S. PATENT DOCUMENTS 5,599,394 * 2/1997 Yaba et al. ..... 118/320
6,033,475 * 3/2000 Hasebe et al. ..... 118/320

FOREIGN PATENT DOCUMENTS 64-64218 3/1989 (JP) .
10-308347 * 11/1998 (JP) ..... 396/FOR 935
11-111662 * 4/1999 (JP) ..... 396/FOR 935

* cited by examiner

*Primary Examiner*—D. Rutledge
(74) *Attorney, Agent, or Firm*—Fulbright & Jaworski L.L.P.

(57) ABSTRACT

A process solution supply system, comprising a process solution supply source from which a process solution is supplied, an intermediate storage mechanism for temporarily storing the process solution supplied from the process solution supply source and for supplying the process solution with predetermined pressure applied thereto, and a fluid supply mechanism for supplying the intermediate storage mechanism with a fluid which applies pressure to the process solution stored in the intermediate storage mechanism, the intermediate storage mechanism including a vessel which has an introduction port and a discharge port for the process solution, stores the process solution supplied through the introduction port and can discharge the process solution, and a compressing member, arranged inside the vessel to be located between the process solution and the fluid supplied from the fluid supply mechanism, for permitting pressure of the fluid to act on the process solution.

30 Claims, 13 Drawing Sheets

PROCESS SOLUTION SUPPLY SYSTEM, SUBSTRATE PROCESSING APPARATUS EMPLOYING THE SYSTEM, AND INTERMEDIATE STORAGE MECHANISM EMPLOYED IN THE SYSTEM

BACKGROUND OF THE INVENTION

The present invention relates to a substrate processing apparatus used in the fabrication process of semiconductor devices, LCDs, or the like, and comprising a process solution supply system for supplying a process solution, such as a developing solution.

In the photolithography step included in the fabrication process of a semiconductor device, a resist solution is coated on a substrate, such as a wafer, to form a resist film. The resist film is exposed to light, with a predetermined pattern used as a mask, and is then subjected to developing treatment, thereby forming the predetermined pattern on the resist film.

These series of process are carried out by a coating-developing system.

In this coating-developing system, process solutions, such as a developing solution and thinner, are supplied to various types of process units provided for the coating-developing system, namely, an adhesion unit, a resist coating unit, a developing unit, etc. The process solutions are first forcibly supplied to an intermediate tank by an $N_2$ gas-based forcible supply apparatus. After being stored in the intermediate tank, the process solutions are supplied to the process units. As a means for supplying the solutions from the intermediate tank, either a pump or an $N_2$ gas-based forcible supply apparatus is employed.

In the case where the pump is used for supplying the process solutions from the intermediate tank to the process units, the process solutions are repeatedly compressed. It is therefore likely that the process solutions are in pulsatory motion when they reach the process units. For this reason, in many cases, the $N_2$ gas-based forcible supply apparatus is employed as the means for supplying solutions from the intermediate tank to the process units. In the case where the $N_2$ gas-based forcible supply apparatus is employed, a compressed $N_2$ gas is blown directly into the process solution stored in the intermediate tank, and the process solution compressed thereby is supplied from the intermediate tank to the process units.

However, when the $N_2$ gas-based forcible supply apparatus is employed, the compressed $N_2$ gas is blown directly against the process solution. As a result, the process solution contains the $N_2$ gas. When the process solution reaches the process units and its pressure decreases, the $N_2$ gas in the process solution may turn into bubbles. If the process unit is, for example, a developing unit, the bubbles of the $N_2$ gas may be included in the developing solution. If this happens, the process may be adversely affected, and uniform development cannot be expected.

In addition, the electronic flowmeters employed in the coating-developing system include a type which cannot make accurate measurement if such bubbles are included. This means that the process solution may not be supplied in an accurate amount.

BRIEF SUMMARY OF THE INVENTION

The present invention has been made in consideration of the above circumstances, and one object of the invention is to provide a process solution supply system capable of forcibly supplying a process solution, such as a developing solution, without producing pulsatory motion and without the feeding gas, such as the $N_2$ gas, being included therein.

Another object of the present invention is to provide a process solution supply system capable of supplying a process solution, such as a developing solution, in such a manner that the process solution can be stably supplied with a constant pressure applied at all times, and in a stable and uninterrupted manner.

Still another object of the present invention is to provide a process solution supply system capable of efficiently removing a feeding gas, such as an $N_2$ gas, from the process solution.

A further object of the present invention is to provide an intermediate storage mechanism employed in a process solution supply system, and also a substrate processing apparatus employing the process solution supply system.

According to one aspect of the present invention, there is provided a process solution supply system comprising:

a process solution supply source from which a process solution is supplied;

an intermediate storage mechanism for temporarily storing the process solution supplied from the process solution supply source and for supplying the process solution with predetermined pressure applied thereto; and a fluid supply mechanism for supplying the intermediate storage mechanism with a fluid which applies pressure to the process solution stored in the intermediate storage mechanism, the intermediate storage mechanism including: a vessel which has an introduction port and a discharge port for the process solution, stores the process solution supplied through the introduction port and can discharge the process solution; and a compressing member, arranged inside the vessel to be located between the process solution and the fluid supplied from the fluid supply mechanism, for permitting pressure of the fluid to act on the process solution.

It is preferable that the system have two or more intermediate storage mechanisms, each of which has the structure described above, and a switching valve for selectively switching among the intermediate storage mechanisms.

The vessel described above preferably has a gas exhaust port through which bubbles contained in the process solution are discharged from the vessel. In this case, it is desirable that the introduction port be provided with a passage for allowing the introduced process solution to decrease in pressure, to thereby produce bubbles of a gas remaining in the process solution.

According to another aspect of the present invention, there is provided a storage mechanism for temporarily storing a process solution supplied from a process solution supply source and for supplying the process solution with predetermined pressure applied thereto, the storage mechanism including: a vessel which has an introduction port and a discharge port for the process solution, stores the process solution supplied from the fluid supply mechanism and can discharge the process solution; a compressing member, arranged inside the vessel to be located between the process solution and the fluid supplied from the fluid supply mechanism, for permitting pressure of the fluid to act on the process solution; and a gas exhaust port, provided for the vessel, for allowing bubbles contained in the process solution to be discharged from the vessel.

According to still another aspect of the present invention, there is provided a substrate processing apparatus comprising: a process solution supply source from which a process solution is supplied; an intermediate storage mechanism for temporarily storing the process solution supplied from the process solution supply source and for supplying the process solution with predetermined pressure applied thereto; a fluid supply mechanism for supplying the intermediate storage mechanism with a fluid which serves to actuate the intermediate storage mechanism; and a treatment section for performing a predetermined treatment with respect to a given object by using the process solution supplied from the intermediate storage mechanism, the intermediate storage mechanism including: a vessel which has an introduction port and a discharge port for the process solution, stores the process solution supplied from the fluid supply mechanism and can discharge the process solution; and a compressing member, arranged inside the vessel to be located between the process solution and the fluid supplied from the fluid supply mechanism, for permitting pressure of the fluid to act on the process solution.

According to still another object of the present invention, there is provided a process solution supplying method in which a process solution supplied from a process solution supply source is first stored in a plurality of intermediate storage mechanisms and then supplied to a predetermined section, the method comprising the steps of: supplying the process solution from a given one of the intermediate storage mechanisms; refilling another one of the intermediate storage mechanisms with the process solution supplied from the process solution supply source, when the process solution is being supplied from the given intermediate storage mechanism; and starting supply of the process solution from the second intermediate storage mechanism upon detection of the end of the supply of the process solution from the given intermediate storage mechanism.

Other specific objects and advantages will be evident when proceeding through the following detailed description of illustrated embodiments of the invention, particularly when considered in connection with the accompanying drawings.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

(First Embodiment)

First of all, a coating-developing system which employs a process solution supply apparatus of the present invention will be described with reference to FIGS. 1–3. Then, a process solution supply apparatus will be described with reference to FIGS. 4–6.

(Coating-developing System)

Figure 1:
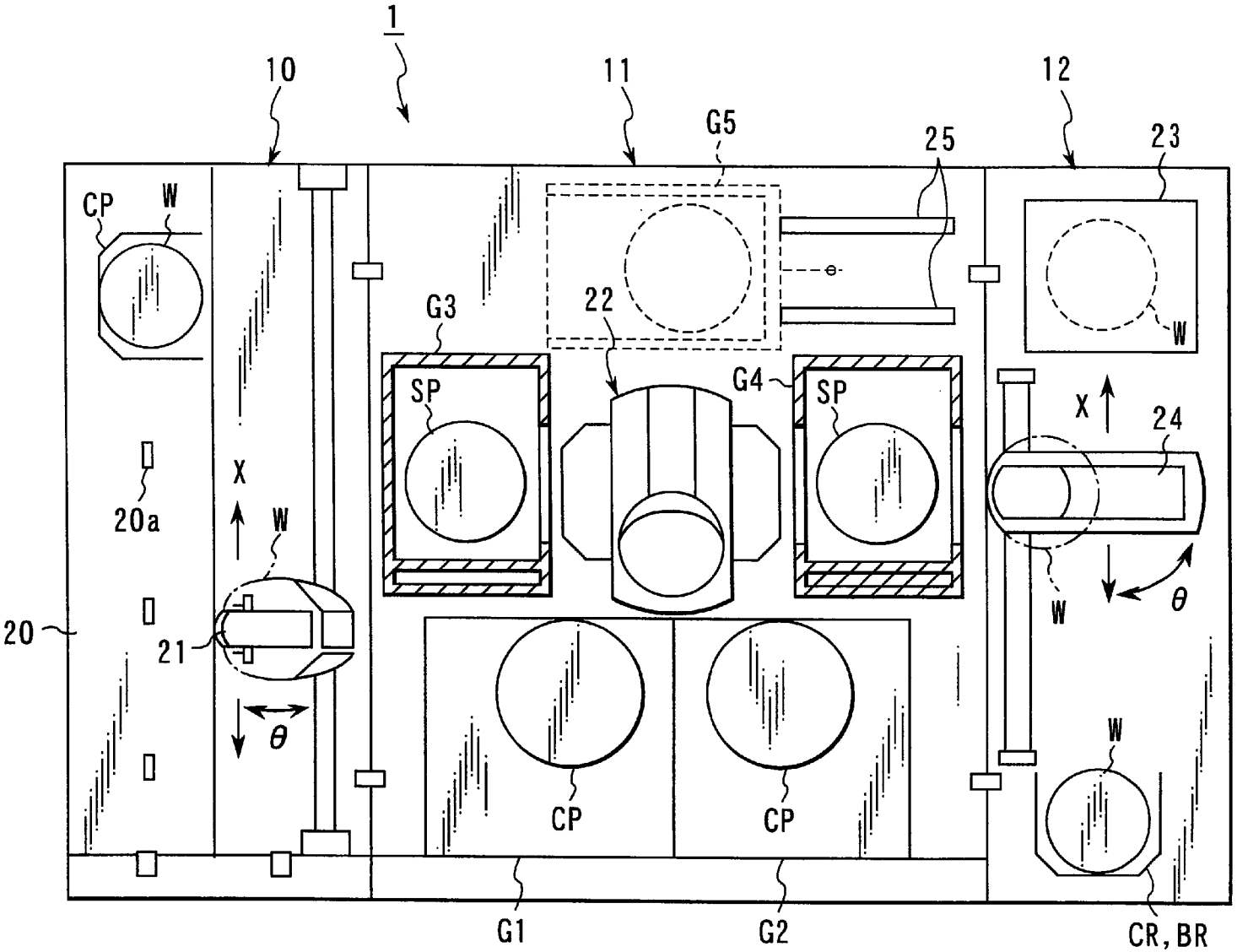
FIG. 1 is a plan view showing the entire coating-developing system for semiconductor wafers, which is one embodiment of the present invention.
Figure 2:
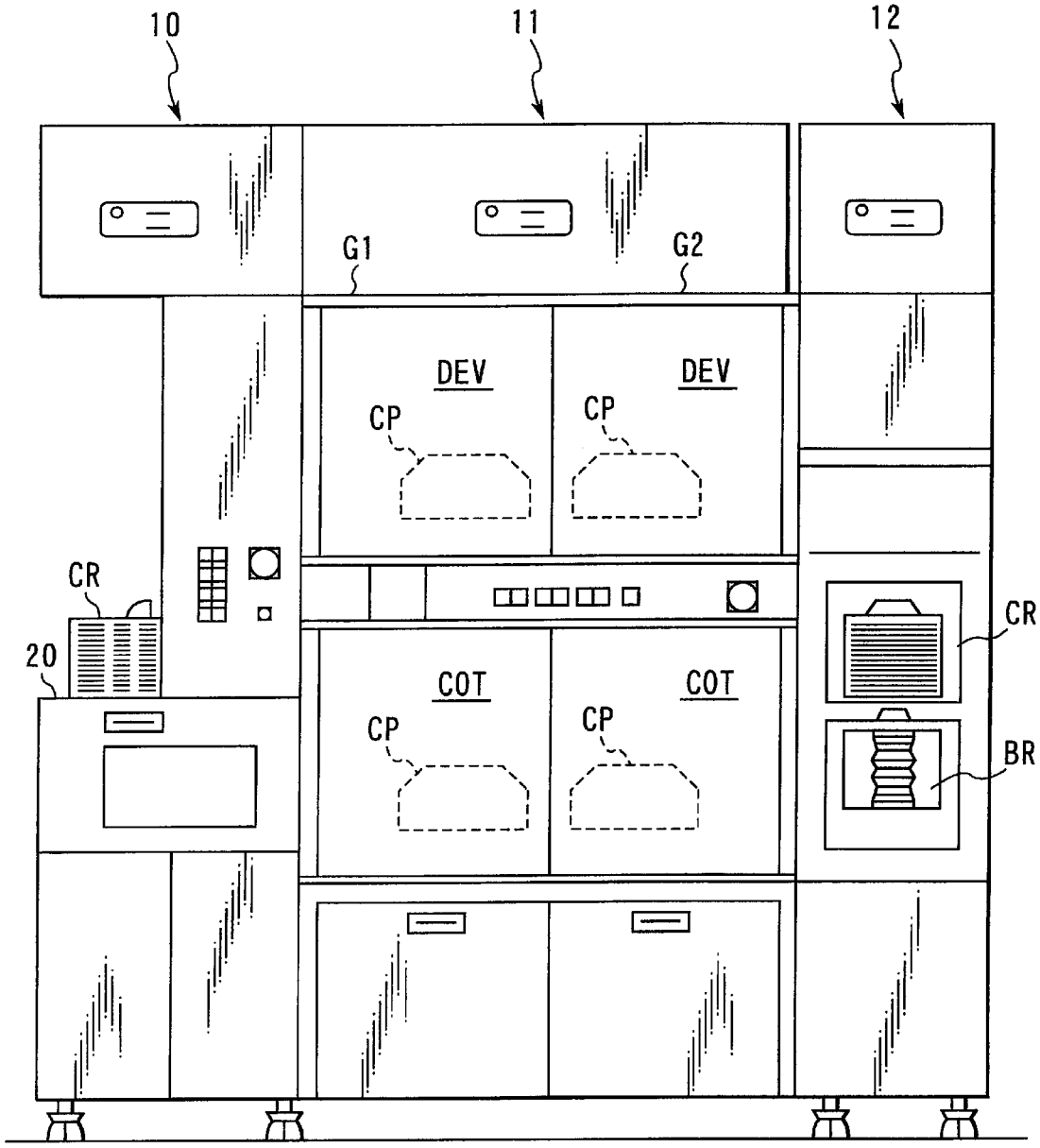
FIG. 2 is a front view of the coating-developing system shown in FIG. 1.
Figure 3:
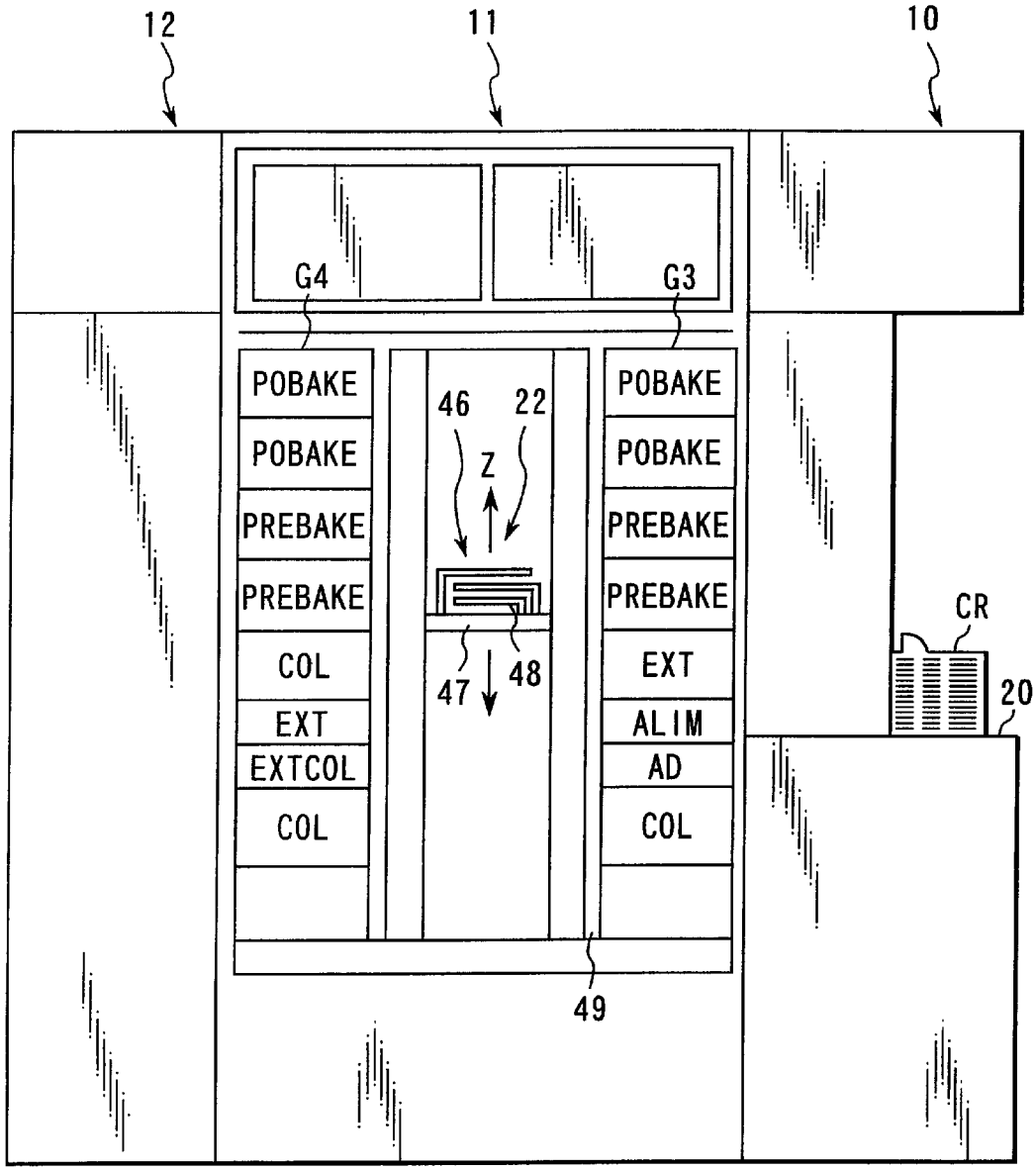
FIG. 3 is a rear view of the coating-developing system shown in FIG. 1.

FIGS. 1–3 show the entire structure of the coating-developing system, FIG. 1 being a plan view of the system, FIG. 2 being a front view thereof, and FIG. 3 being a rear view thereof.

As shown in FIG. 1, the coating-developing system 1 is provided with: a cassette section 10 for sequentially taking out wafers W from a cassette CR; a processing section 11 for coating a resist solution on a wafer W taken out by the cassette section 10 and for executing a developing process with respect to the wafer W; and an interface section 12 for transferring the wafer W having a coating of the resist solution to an exposure apparatus (not shown).

The cassette section 10 has four projections 20*a* for positioning and holding the cassette CR, and a first sub arm mechanism 21 for taking out a wafer W from the cassette CR held by the projections 20*a*. After taking out the wafer W, the sub arm mechanism 21 is rotated in the θ direction and transfers the wafer W to a main arm mechanism 22 provided for the processing section 11.

The wafer W is transferred between the cassette section 10 and the processing section 11 by way of a third processing unit group G3. As shown in FIG. 3, the third processing unit group G3 is made of a plurality of processing units stacked one upon another in such a manner as to constitute a vertical structure. To be more specific, the processing unit group G3 includes a cooling unit (COL) for cooling the wafer W, an adhesion unit (AD) for performing a hydrophobic treatment so as to improve the fixing characteristic which the resist solution has with reference to the wafer W, an alignment unit (ALIM) for positioning the wafer W, an extension unit (EXT) in which the wafer W is stored in the stand-by state, two pre-baking units (PREBAKE) for performing heat treatment before the exposure process, and two post-baking units (POBAKE) for performing heat treatment after the exposure process. These units are stacked one upon another in the order mentioned.

The wafer W is transferred to the main arm mechanism 20 by way of the extension unit (EXT) and the alignment unit (ALIM).

As shown in FIG. 1, first through fifth processing unit groups G1–G5, among which the third processing unit group G3 described above is included, are arranged around the main arm mechanism 22 in such a manner that they surround the main arm mechanism 22. Like the third processing unit group G3, each of the other processing unit groups G1, G2, G4 and G5 is formed by stacking various kinds of processing units one upon another in the vertical direction.

As shown in FIG. 2, resist solution coating apparatuses (COT) are included in the first and second processing unit groups G1 and G2. As shown in the same Figure, each of the first and second processing unit groups G1 and G2 is made by vertically arranging the resist solution coating apparatuses (COT) and developing apparatuses (DEV).

As shown in FIG. 3, the main arm mechanism 22 is vertically driven along a cylindrical guide 49 extending in the vertical direction. The main arm mechanism 22 can be revolved in a horizontal plane and can be advanced or retreated. With this structure, the wafer W can be supplied to an arbitrary one of the processing unit groups G1–G5 by vertically driving the main arm mechanism 22.

The main arm mechanism 22 receives the wafer W from the cassette section 10 by way of the extension unit (EXT) of the third processing unit group G3. Upon reception of the wafer W, the main arm mechanism 22 first conveys it to the adhesion unit (AD) of the third processing unit G3, for execution of a hydrophobic treatment. Then, the main arm mechanism 22 takes the wafer out of the adhesion unit (AD) and conveys it to the cooling unit (COL) for cooling.

After being cooled, the wafer W is moved by the main arm mechanism 22 to a position facing the resist solution coating apparatus (COT) of the first processing unit group G1 (or the second processing unit group G2). From that position, the wafer W is loaded into the resist solution coating apparatus.

By the resist solution coating apparatus, the resist solution is coated on the wafer. Thereafter, the wafer is unloaded from the resist solution coating apparatus by the main arm mechanism 22, and transferred to the interface section 12 by way of the fourth processing unit group G4.

As shown in FIG. 3, the fourth processing unit group G4 includes a cooling unit (COL), an extension cooling unit (EXT.COL), an extension unit (EXT), two pre-baking units (PREBAKE), and two post-baking units (POBAKE). These units are stacked one upon another in the order mentioned.

After being taken out from the resist solution coating apparatus (COT), the wafer W is first inserted into the pre-baking unit (PREBAKE). This unit removes the solvent from the resist solution and dries the wafer. Then, the wafer is cooled by the cooling unit (COL), and transferred to a second sub arm mechanism 24 provided in the interface section 12 by way of the extension unit (EXT).

Upon receipt of wafers W, the second sub arm mechanism 24 successively store them in the cassette CR. The interface section 12 transfers the cassette CR containing wafers W to the exposure apparatus (not shown), and receives another cassette CR that stores the wafers subjected to the exposure process.

The wafers W subjected to the exposure process are transferred to the main arm mechanism 22 by way of the fourth processing unit group G4. The main arm mechanism 22 inserts the wafers W into the post baking unit (POBAKE), if necessary, and then inserts them in the developing apparatus (DEV), for the execution of a developing process. After the developing process, the wafers W are conveyed to one of the backing units, where they are heated and dried. Thereafter, the wafers W are discharged into the cassette section 10 by way of the extension unit (EXT) of the third processing unit group G3.

The fifth processing unit group G5 is an optional unit group. In the first embodiment, the fifth processing unit group G5 has a similar structure to that of the fourth processing unit group G4. The fifth processing unit group G5 is movable along a rail 25, so that the main arm mechanism 22 and the first to fourth processing unit groups G1–G4 can be easily maintained.

In the coating-developing system described above, the processing units are vertically arranged, with one stacked upon another. This structure is advantageous in that the installation area required is as narrow as possible.

(Process Solution Supply System)

A process solution supply apparatus having the features of the present invention will now be described with reference to FIGS. 4–6. The process solution supply system is incorporated in the coating-developing system described above. For example, the process solution supply system is used for supplying a developing solution (a process solution) to the developing unit (DEV).

Figure 4:
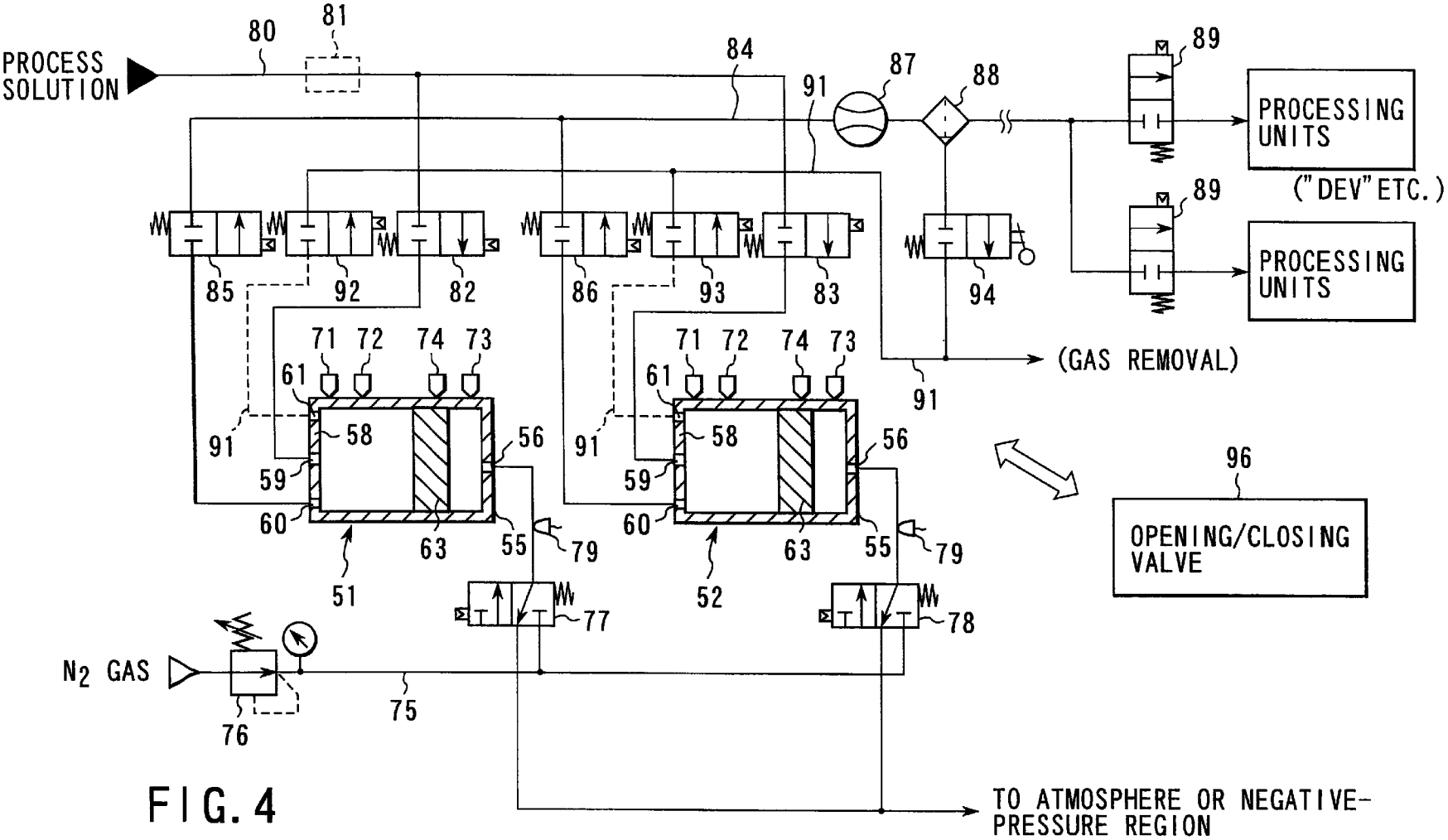
FIG. 4 shows the piping structure employed in the process solution supply system (process solution supply mechanism) according to one embodiment of the present invention.

FIG. 4 shows the piping structure employed in the process solution supply system of the embodiment.

The process solution supply system receives and stores a process solution, such as a developing solution, from a supply source (e.g., the piping system of a factory). The process solution is forcibly supplied to the process solution supply system by means of an $N_2$ gas-based forcible supply system or a pump system. Then, the process solution supply system forcibly supplies the process solution to a processing unit, such as a developing unit (DEV). That is, the process solution supply system functions as an intermediate storage mechanism as well.

As the intermediate storage mechanism of the system, syringe pumps 51 and 52 are used. Owing to the use of this type of pumps, the $N_2$ gas for compressing does not touch the process solution, and yet the process solution can be supplied in a stable manner and with constant pressure applied thereto.

The process solution supply system of the present invention uses two syringe pumps 51 and 52. Even when the supply of the process solution supplied by one (51) of them comes to an end, the other syringe pump (52) can be used instead. Accordingly, the process solution can be supplied uninterruptedly. The two syringe pumps will be described in more detail, with one of them referred to as the first syringe pump 51 and the other as the second syringe pump 52.

Before reference is made to the piping system of the present invention, the structure of the first and second syringe pumps 51 and 52 will be described with reference to FIG. 5A. Since these two pumps are identical in structure, a description will be given of the first syringe pump 51, and a description of the second syringe pump 52 will be omitted.

Figure 5A:
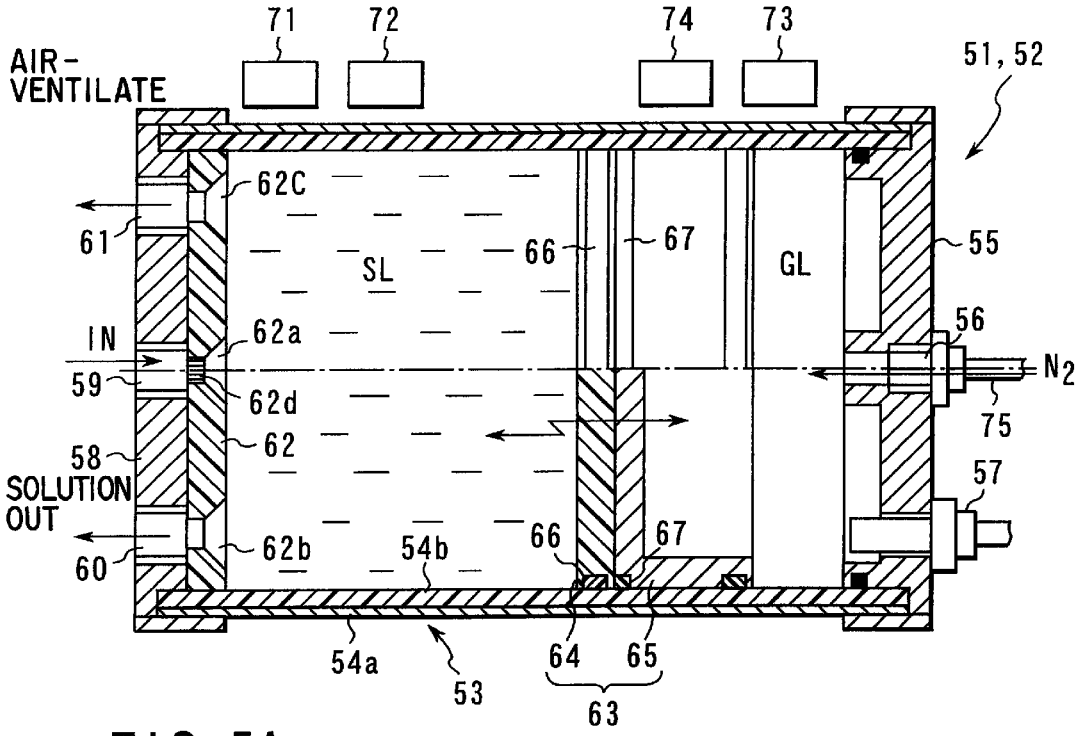
FIG. 5A is a longitudinal sectional view of a syringe pump employed in the process solution supply system shown in FIG. 4.
Figure 5B:
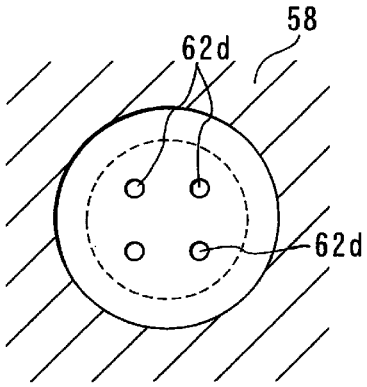
FIGS. 5B and 5C are a cross sectional view and a longitudinal sectional view, each showing the process solution-introducing portion of the syringe pump on an enlarged scale.
Figure 5C:
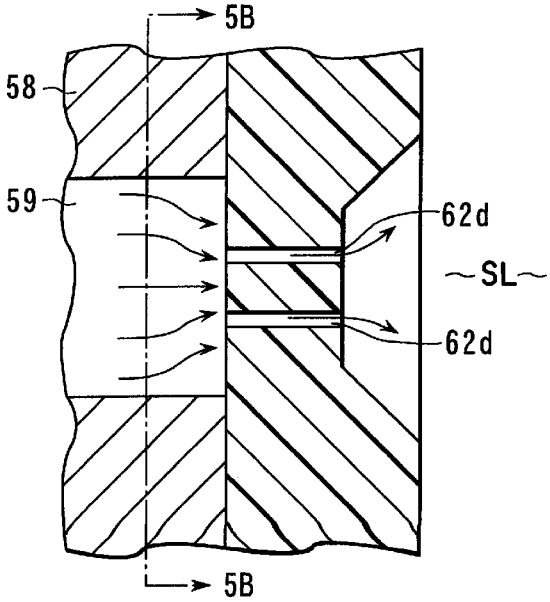

As shown in FIG. 5A, the first syringe pump 51 comprises a cylinder 53 which is laid, and a piston 63 which is inside the cylinder 53 and slidable in the horizontal direction. By the piston 63, the interior of the cylinder 53 is partitioned into a process solution chamber SL located on the left side and a driving gas chamber GL located on the right side. The piston 63 is driven in the leftward direction (in the direction toward the process solution chamber SL) when a driving gas, such as $N_2$ gas, is introduced into the driving gas chamber GL. In accordance with the leftward movement of the piston 63, the process solution in the process solution chamber SL is compressed.

The cylinder 53 comprises a cylindrical body 54*a* formed of a metallic material and having open ends; a resin liner 54*b* attached to the inner circumferential face of the cylindrical body 54*a* and being resistant to the process solution; a cover 55 for closing the right end of the cylindrical body 54*a;* and a head 58 for closing the left end of the cylindrical body 54*a*.

The cover 55 is provided with a connection port 56 to which an $N_2$ gas supply pipe 75 (which will be described later) is connected, and a leak sensor 57. The head 58 is provided with a process solution discharge port 60, a process solution introduction port 59, and a gas discharge port 61 through which bubbles of $N_2$ gas are removed. Ports 60, 59 and 61 are located at lower, intermediate and upper levels, respectively.

A resin liner 62 is attached to the inner side of the head 58. The liner 62 has communication holes 62*a*–62*c* at positions corresponding to the discharge port 70, the introduction port 59 and the gas discharge port 61, respectively. Of the three communication holes 62*a*–62*c,* the hole 62*a* corresponding to the introduction hole 59 has a large number of orifice holes 62*d,* as shown on an enlarged scale in FIGS. 5B and 5C.

In the case where the diameter of the introduction port 59 is 6 mm, five to thirteen thin orifice holes 62*d,* each having a diameter of 0.3 to 0.5 mm, are provided. With this structure, the process solution passing through the orifice holes 62*d* decreases in pressure (so-called "orifice effects"). Even if gases like the $N_2$ gas are dissolved in the process solution, they bubble when the process solution passes through the orifice holes. Hence, the bubbles can be discharged from the gas discharge port 61.

As shown in FIG. 5A, the piston 63 is made up of a surface member 64 formed of resin, such as Teflon (trademark), and kept in contact with the process solution, and a piston base 65 formed of a metallic material and supporting the surface member 64. The surface member 64 has a resin seal ring 66 at the outer circumference thereof, so that the process solution chamber and the driving gas chamber can be separate from each other in an airtight and solution-tight manner. The piston base 65 has a magnet 67 for position detection at the outer circumference thereof.

With this structure, when the pressure in the driving gas chamber GL is reduced by use of the connection port 56, the piston 63 is driven to the right (i.e., in the direction toward GL), the solution treatment is introduced into the process solution chamber SL from the introduction port 59. Conversely, when the $N_2$ gas is introduced into the driving gas chamber GL from the connection port 56, and the piston 63 is driven to the left, the process solution contained in the process solution chamber SL is discharged from the syringe pump 51 through the discharge port 60. Immediately after this solution discharge, the bubbles contained in the process solution are removed from the gas discharge port 61.

An empty-state sensor 71 and a full-state sensor 73 are arranged outside of the cylinder 53. The empty-state sensor 71 senses the state where the piston 63 is at the left end position and the syringe pump 51 is empty of the process solution, while the full-state sensor 73 senses the state where the piston 63 is at the right end position and the syringe pump 51 is full of the process solution. An almost-empty-state sensor 72 and an almost-full-state sensor 74 are arranged close to the empty-state sensor 71 and the full-state sensor 73, respectively. The almost-empty-state sensor 72 senses the state where the syringe pump 51 is about to become empty of the process solution, while the almost-full-state sensor 74 senses the state where the syringe pump 51 is about to become full of the process solution.

The sensors 71–74 described above sense the magnetic field generated by the magnet 67 fitted around the piston base 65.

With reference to FIG. 4, a description will now be given of a piping system employing the first and second syringe pumps 51 and 52 described above.

First of all, the $N_2$ gas supplying system for driving the syringe pumps will be described.

As described above, the first and second syringe pumps 51 and 52 are driven by use of the $N_2$ gas. An $N_2$ gas supply pipe 75, into which the $N_2$ gas from the piping system of a factory are supplied, is connected to the connection ports 56 of the first and second syringe pumps 51 and 52.

The $N_2$ gas supply pipe 75 is provided with a regulator 76 (a pressure regulating valve) for regulating the pressure of the $N_2$ gas supplied from the piping system of the factory. At positions downstream of this regulator 76, the $N_2$ gas supply pipe 75 is provided with two three-way valves, namely first and second three-way valves 77 and 78 for the $N_2$ gas supply. The three-way valves 77 and 78 are used for selecting the destination of the $N_2$ gas, i.e., either the first syringe pump 51 or the second syringe pump 52. When the first and second three-way valves 77 and 78 are switched over to the regulator 76, the $N_2$ gas whose pressure is kept substantially constant by the regulator 76 is supplied to the first and second syringe pumps 51 and 52.

By the first and second three-way valves 77 and 78, the flow passages leading to the first and second syringe pumps 51 and 52 can be switched over to the atmosphere (or to a negative-pressure region). When the flow passages are switched over to the atmosphere (or to the negative-pressure region), the pressure differences produced inside the syringe pumps 51 and 52 cause the pistons 63 to move to the right, as viewed in FIG. 5A. As a result, the process solution is introduced into the process solution chamber SL.

Leak sensors 79 are provided for the pipe 75 in such a manner that one is located between the first syringe pump 51 and the first three-way valve 77 and the other is located between the second syringe pump 52 and the second three-way valve 78.

The process solution supply system will be described.

Reference numeral 80 in FIG. 4 denotes a process solution pipe through which a process solution is supplied from the piping system of the factory. The process solution pipe 80 is provided with a gas removing member 81 for removing $N_2$ gas bubbles from the process solution that is forcibly supplied from the piping system of the factory. At positions downstream of the process solution piping 80, the first and second syringe pumps 51 and 52 are connected to the process solution pipe 80 in such a manner that the pumps 51 and 52 are parallel to each other.

To be more specific, the process solution piping 80 has two branch sections at the downstream positions. One of the branch sections is connected to the introduction port 59 of the first syringe pump 51 by way of a first introduction-side opening/closing valve 82; likewise, the other branch section is connected to the introduction port 59 of the second syringe pump 52 by way of a second introduction-side opening/closing valve 83. The discharge ports 60 of the first ad second syringe pumps 51 and 52 are led by way of first and second discharge-side opening/closing valves 85 and 86, respectively, and are then connected together as a single downstream pipe 84.

The downstream pipe 84 is provided with a flowmeter 87, a filter for removing the $N_2$ gas, and opening/closing valves 89 each having a flow rate-regulating function. Through these structural components, the downstream pipe 84 is connected to processing units, such as developing units (DEV).

A drain pipe 91 is connected to the gas discharge ports 61 of the first and second syringe pumps 51 and 52. The drain pipe 91 is provided with two valves for closing/opening the pipe, i.e., the first and second gas-removing valves 92 and 93. A branch pipe extending from the filter 88 to the drain pipe 91 is provided with a third gas-removing opening/closing valve 94.

With the above structure, the opening/closing valves 82, 83, 85, 86, 92, 93 and 94 and the first and second three-way valves 77 and 78 are selectively operated at predetermined timings, and by doing so, one of the first and second syringe pumps 51 and 52 can be selected and the supply of the process solution can be performed by use of the selected syringe pump. In FIG. 4, reference numeral 96 denotes a controller for controlling the opening/closing valves.

A description will now be given with reference to FIG. 6 as to how the control device controls the timings at which the opening/closing valves are operated.

Figure 6:
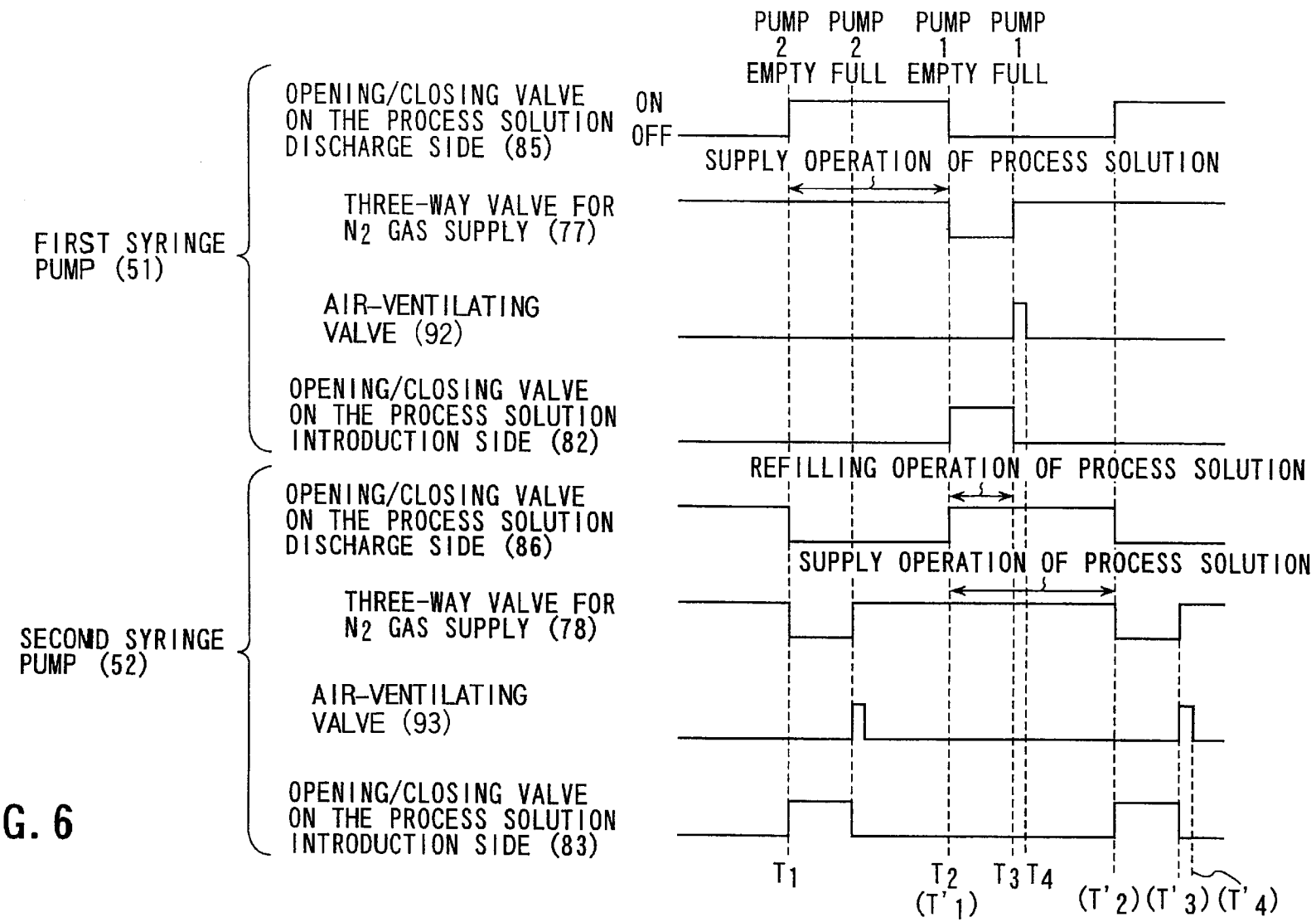
FIG. 6 is a timing chart showing how the process solution supply system performs a process solution supply operation.

In FIG. 6, the timing chart of the first syringe pump 51 is shown in the upper half, while the timing chart of the second syringe pump 52 is shown in the lower half. For convenience of explanation, the control timings of the two syringe pumps will be described without reference to each other.

First of all, at time T1, the first discharge-side opening/closing valve is opened, so that the process solution is supplied by the first syringe pump 51. When the empty-state sensor 71 senses the empty state of the process solution chamber SL, the first discharge-side opening/closing valve 85 is set in the closed state. As a result, the supplying of the process solution is stopped (at time T2). The length of time required for the solution supply varies, depending upon the capacity of the pump and the amount of process solution needed. In the case of an ordinary coating-developing process, the time ranges from about 10 minutes to 5 or 6 hours.

Simultaneous with the stop of the solution supply (time t2), the first three-way valve 77 is switched over to the atmosphere or a negative-pressure region, and the first introduction-side opening/closing valve 82 is opened. As a result, the piston shown in FIG. 5A is moved to the right as viewed in the Figure, being pushed by the pressure of the process solution. In this manner, the process solution chamber SL of the cylinder 53 is refilled with the process solution.

At this time, the process solution flows from the introduction port 59 into the cylinder 53 while passing through the orifice holes 62*d*. Since the process solution temporarily decreases in temperature when passing through the orifice holes 62*d*, the gas components (such as the $N_2$ gas) dissolved in the process solution begin to bubble.

When the full-state sensor 73 senses that the process solution chamber SL is filled with the process solution, the introduction-side opening/closing valve 82 is closed, and the refilling operation of the process solution is ended (at time T3). Substantially simultaneous with the end of the refilling operation, the first gas-removing valve 92 is opened; in other words, it is opened substantially at time T3. Accordingly, the $N_2$ gas which bubbles in the process solution is discharged from the gas-discharge port 61 of the head 58. Since the gas discharge port 61 is located close to the top of the cylinder 53, the gas can be discharged with high efficiency.

Simultaneous with the start of the gas discharge operation, i.e., at time T3, the first three-way valve 77 is switched over to the regulator 76. As a result, the $N_2$ gas is introduced into the driving gas chamber GL of the cylinder 53, and the pressure of the $N_2$ gas pushes the piston 63 to the left, as viewed in FIG. 5A, thus starting the compression of the process solution contained in the process solution chamber SL. The compression of the process solution enhances the efficiency with which the bubbles in the process solution are discharged from the gas discharge port 61.

At the end of the gas discharge, the first gas-removing valve 92 is closed (at time T4).

By repeating the operations corresponding to times T1–T4, the first syringe pump 51 repeats the filling and supplying operations of the process solution.

The second syringe pump 52 performs the operation (the supply of the process solution) similar to that of the first syringe pump 51 at time T1', which is the same time as time T2 when the supply of the process solution by the first syringe pump 51 is ended. The first syringe pump 51 is refilled with the process solution (from time T2 to time T3), when the supply of the process solution by the second syringe pump 52 is in progress (from time T1' to time T2'). The first syringe pump 51 starts supplying the process solution in synchronism with the end of the supply of the process solution from the second syringe pump 52.

With this structure, the process solution can be supplied uninterrupted by using the first and second syringe pumps in turn.

A more detailed description will be given of the manner in which the $N_2$ gas supply three-way valve 77, the gas-removing valve 92, and the introduction-side opening/closing valve 82 are controlled at times T3 and T4. More specifically, those valves are controlled in accordance with the timing chart shown in FIG. 7. The control based on the timing chart shown in FIG. 7 enables the process solution to be supplied in a stable manner without producing pulsatory motion.

Figure 7:
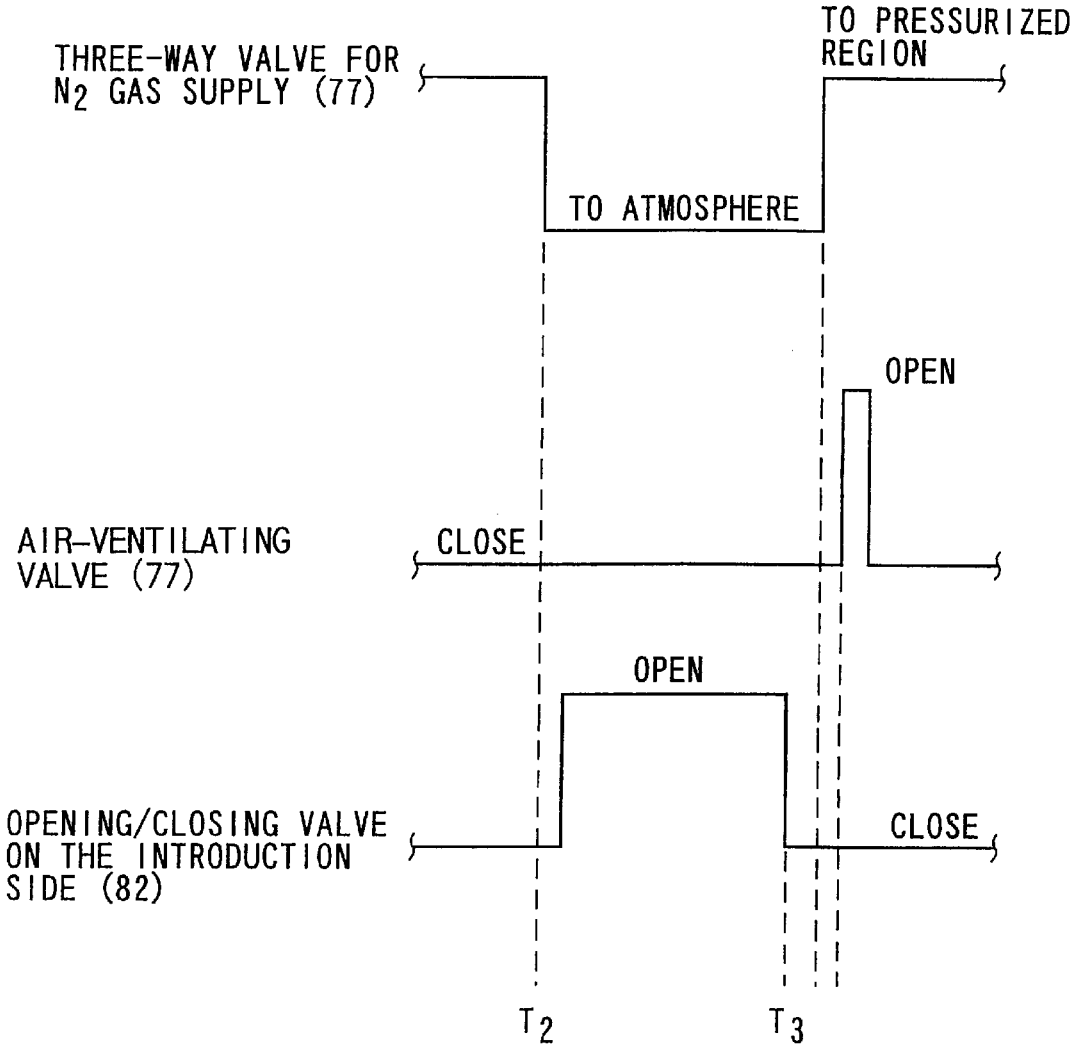
FIG. 7 is a timing chart showing in more detail part of the process solution supply operation shown in FIG. 6.

Referring to FIG. 7, the $N_2$ gas supply three-way valve 77 is switched over to the atmosphere at time T2. As a result, the pressure in the $N_2$ gas chamber GL decreases. When the pressure becomes fully low and stable (after about 50 seconds), the introduction-side opening/closing valve 82 is opened. Thus, the process solution begins to flow into the process solution chamber SL.

When the full-state sensor 73 senses that the process solution has been flown into chamber SL in a full amount, the introduction-side opening/closing valve 82 is closed at time T3. The cylinder 53 is left to stand in this state for amount 120 seconds until the process solution in the cylinder 53 becomes stable.

Thereafter, the three-way valve 77 is switched over to the pressurized region, and the driving $N_2$ gas is introduced into the gas chamber GL. As a result, the compression of the process solution in the process solution chamber SL is started. After the pressure in the gas chamber GL becomes stable (after about 15 seconds), the gas-removing valve 92 is opened for the removal of gas bubbles. The gas removal time is 0.1 to 3.0 seconds, during which the gas-removing valve 92 is kept open. The removal time can be varied in units of 0.1 seconds.

Owing to the structure described above, the following advantages are obtained.

Since the above embodiment uses the syringe pumps 51 and 52 to forcibly supply the process solution, the $N_2$ gas does not touch the process solution. Accordingly, the $N_2$ gas is prevented from being contained in the process solution. It should be also noted that the process solution is not repeatedly compressed before it is supplied. It is compressed by applying constant pressure in one direction at all times, so that no pulsatory motion is produced in the process solution that is supplied.

Even if the process solution supplied from the piping system of the factory contains $N_2$ gas, it is cleared of the $N_2$ gas due to the provision of the gas discharge port 61 and the orifice holes 62*d* communicating with the introduction port 59.

According to the structure described above, the two syringe pumps 51 and 52 are switched from one to the other and used in turn for forcibly supplying the process solution to the processing units. Accordingly, the process solution can be supplied uninterrupted. In addition, the solution can be forcibly supplied by pressurizing the solution with constant pressure at all times.

Where the first and second syringe pumps 51 and 52 are arranged in such a manner that their pistons 63 can slide substantially in a horizontal direction, the pumps 51 and 52 are not adversely affected by the head of the process solution, as in the case where they are stood. Accordingly, the pressure can be controlled with high precision.

The positions of the pistons 63 are accurately sensed by the sensors 71–74. Therefore, the opening/closing valves 82, 83, 85 and 86 can be accurately controlled on the basis of the sensing signals of the sensors 71–74.

Figure 8:
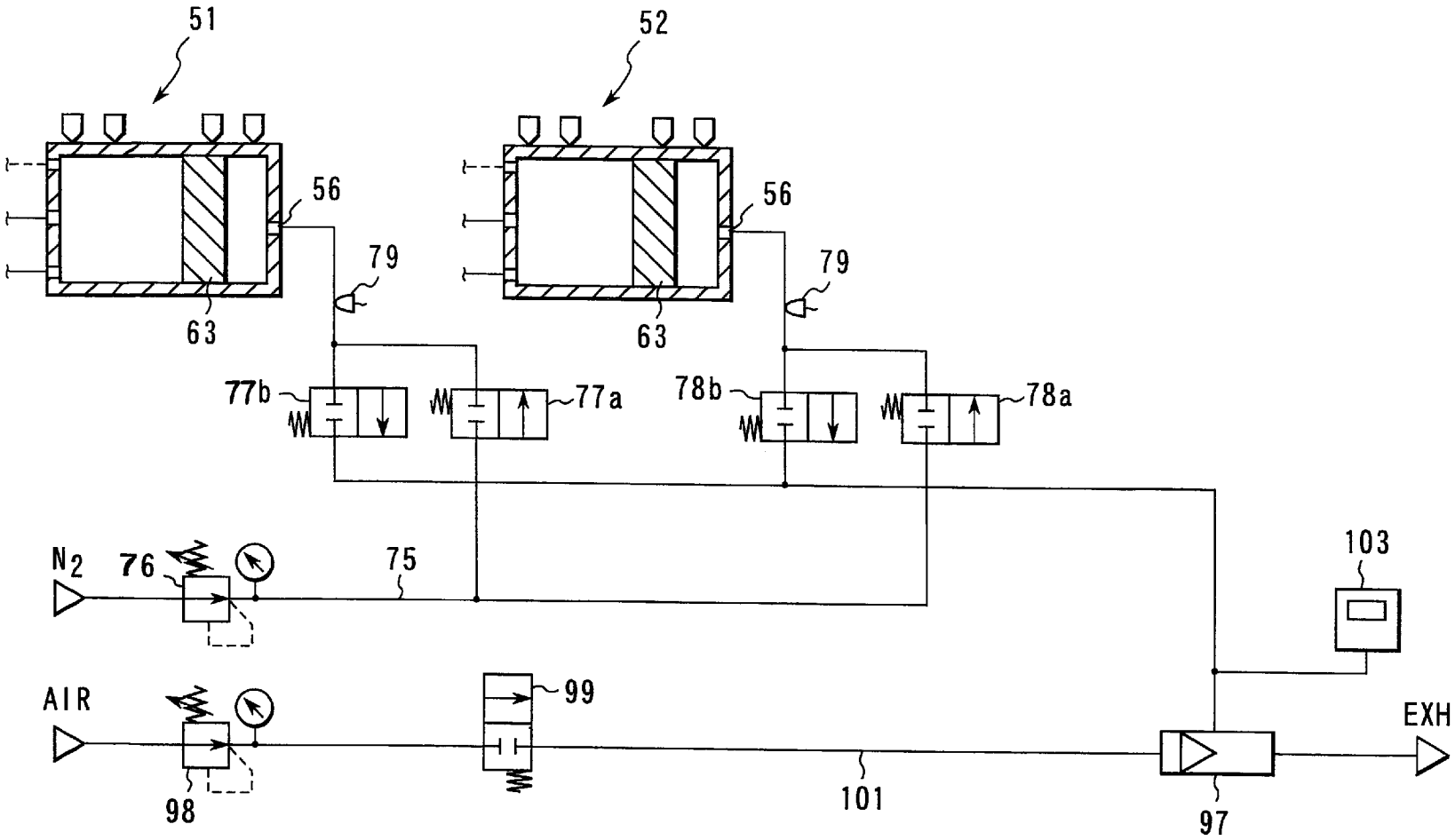
FIG. 8 shows an alternative piping structure.
Figure 9:
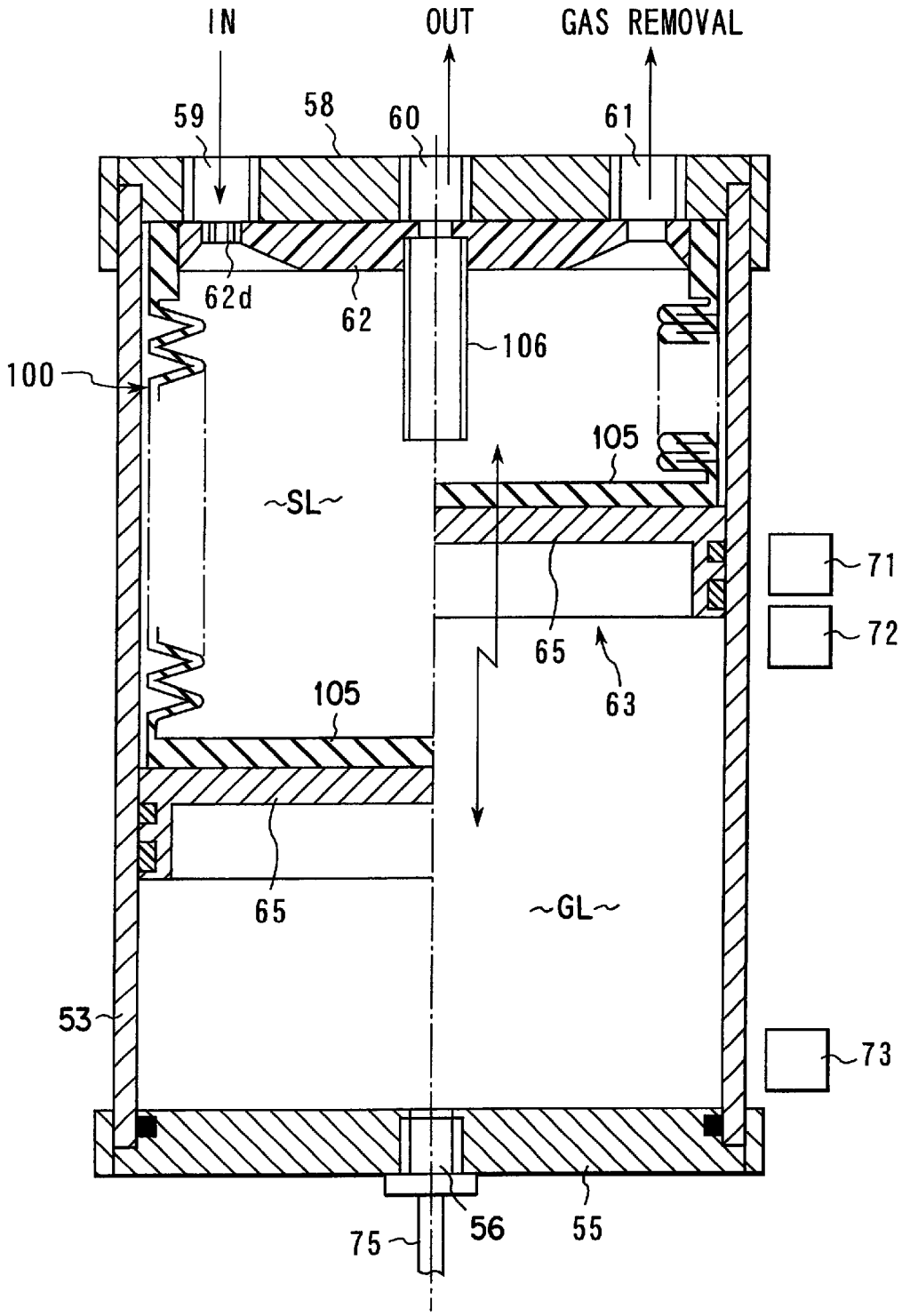
FIG. 9 illustrates the second embodiment of the present invention and is a longitudinal sectional view of the bellows pump employed in the embodiment.

In the embodiment, the connection ports 56 of the syringe pumps 51 and 52 are selectively connected either to the $N_2$ gas (regulator 76) or to the atmosphere. If the pressure with which to supply the process solution is comparatively low, the connection ports 56 may be connected to a negative-pressure region. By so doing, the forcible supply of a solution is enabled. FIG. 8 shows an example of a system wherein the connection ports 56 are connected to the negative-pressure region.

FIG. 8 shows only the $N_2$ gas supply system including the first and second syringe pumps 51 and 52. In FIG. 8, the same reference numerals as used in FIG. 4 indicate similar or corresponding structural elements, and a detailed description of such structural elements will be omitted.

In the system shown in FIG. 8, the first three-way valve 77 is replaced with two opening/closing valves 77*a* and 77*b*, and the second three-way valve 78 is replaced with two opening/closing valves 78*a* and 78*b*. Each of the pipes connected to the connection ports 56 of the syringe pumps has two branch portions at an upstream position, and one of the branch portions is connected to the $N_2$ gas supply pipe 75 by way of the opening/closing 77*a* or 78*a* (which is used for the supply of a gas), while the other branch portion is connected to a negative pressure-generating ejector 97 by way of the opening/closing valve 77*b* or 78*b* (which is used for the reduction of pressure).

The ejector 97 is operated pneumatically to generate negative pressure, and is connected to an air pipe. The air pipe 101 has a regulator 98 at an upstream position, so as to control the pressure of the driving air. An ejection opening/closing valve 99 is arranged between the regulator 98 and the ejector 97.

When the ejection opening/closing valve 99 and the pressure-reducing opening/closing valve 77*b* (78*b*) are opened, the gas chambers of the first and second syringe pumps 51 and 52 are evacuated of air by the ejector 97.

In FIG. 8, reference numeral 102 denotes a leak sensor for detecting pressure leak, and numeral 103 denotes a vacuum gauge for monitoring the degree of negative pressure.

With the structure shown in FIG. 8, the syringe pumps 51 and 52 can be refilled with the process solution in a short time. In addition, since the pressure of the solution can be set to be lower than the atmospheric pressure, the gas can be removed from the solution with high efficiency.

(Second Embodiment)

The second embodiment of the present invention will now be described.

The second embodiment is featured in that the bellows pumps 51' and 52' are employed in place of the first and second syringe pumps 51 and 52 of the first embodiment. In describing the second embodiment, the same reference numerals or symbols as used in the description of the first embodiment will be used to denote similar or corresponding structural elements, and detailed reference to such structural elements will not be made.

The bellows pump 51' comprises a cylinder 53, a cover 55 and a head 58, which are similar to those of the syringe pump 51 of the first embodiment. A bellows formed of resin is arranged inside the cylinder 53 in such a manner that the bellows can be expanded or contracted. The proximal portion of the bellows 100 is attached to a piston base 65 formed of metal or resin. The interior of the bellows 100 can be filled with a process solution. When the piston base 65 is pushed up by the uniform pressure applied thereto, the process solution inside the bellows 100 is pressurized with a constant pressure and discharged from the bellows.

Unlike the syringe pumps of the first embodiment, the bellows pump 51' is stood in such a manner that the piston 63 is movable in a substantially vertical direction, and with the head 58 located on top. If the bellows pump 51' is laid, bubbles generated in the pleats stay there and cannot be easily removed. Since the bellows pump 51 of the second embodiment is stood, the bubbles generated in the process solution can easily collect, and can be readily discharged through a gas discharge port 61.

A suction pipe 106, extending downward inside the bellows 100 and having a certain length, is connected to a discharge port 60. Since the suction pipe 106 provides an offset between the region which is near the lower face of the head 58 and the region at which the process solution is sucked (i.e., the region where the lower end of the suction pipe 106 is located), the bubbles generated in the orifice holes 62*d* of the introduction port 62 are prevented from being removed by way of the discharge port 60.

Since the bellows pump 51' does not comprise a sliding component, such as a piston 63, dust or other undesirable substance is not generated. Another advantage of the bellows type pump is that the driving $N_2$ gas does not leak into the process solution SL. This means that the pump need not employ a leak sensor. Needless to say, it is desirable that a process solution sensor be provided for a pipe portion located near the connection port 56 of the bellows pump, because the sensor would sense the solution leaking from the connection port if the bellows should be damaged.

Figure 10:
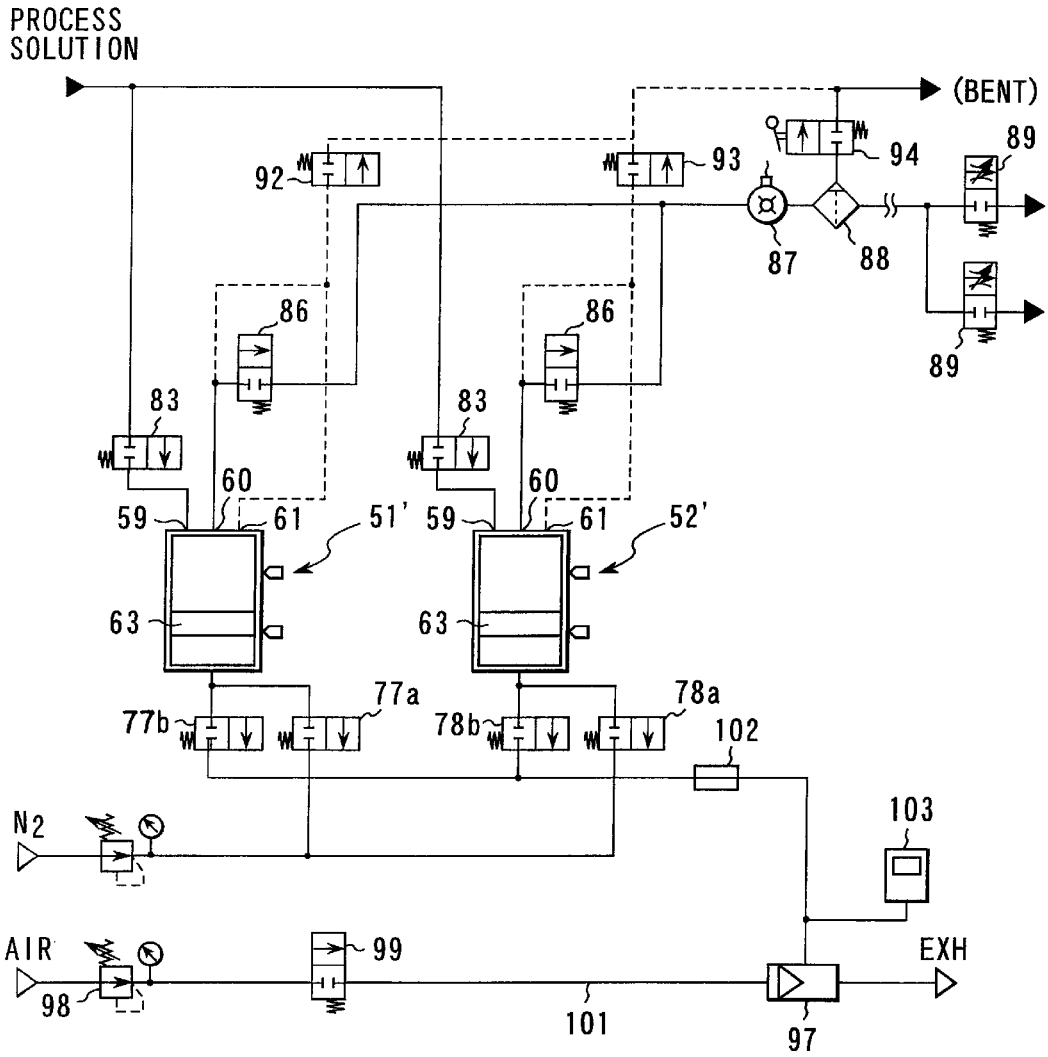
FIG. 10 shows the piping structure employed in the second embodiment.

FIG. 10 shows an example of a piping structure where two bellows pumps 51' and 52' are employed. In FIG. 10, the same reference numerals or symbols as used in FIG. 4 (the first embodiment) denote similar or corresponding structural elements. In the example shown in FIG. 10, the structure shown in FIG. 8, which utilizes a negative pressure, is adopted as the refilling means. Since the piping structure shown in FIG. 10 is similar to that described above, a description of that structure will be omitted for avoiding redundancy.

Figure 11:
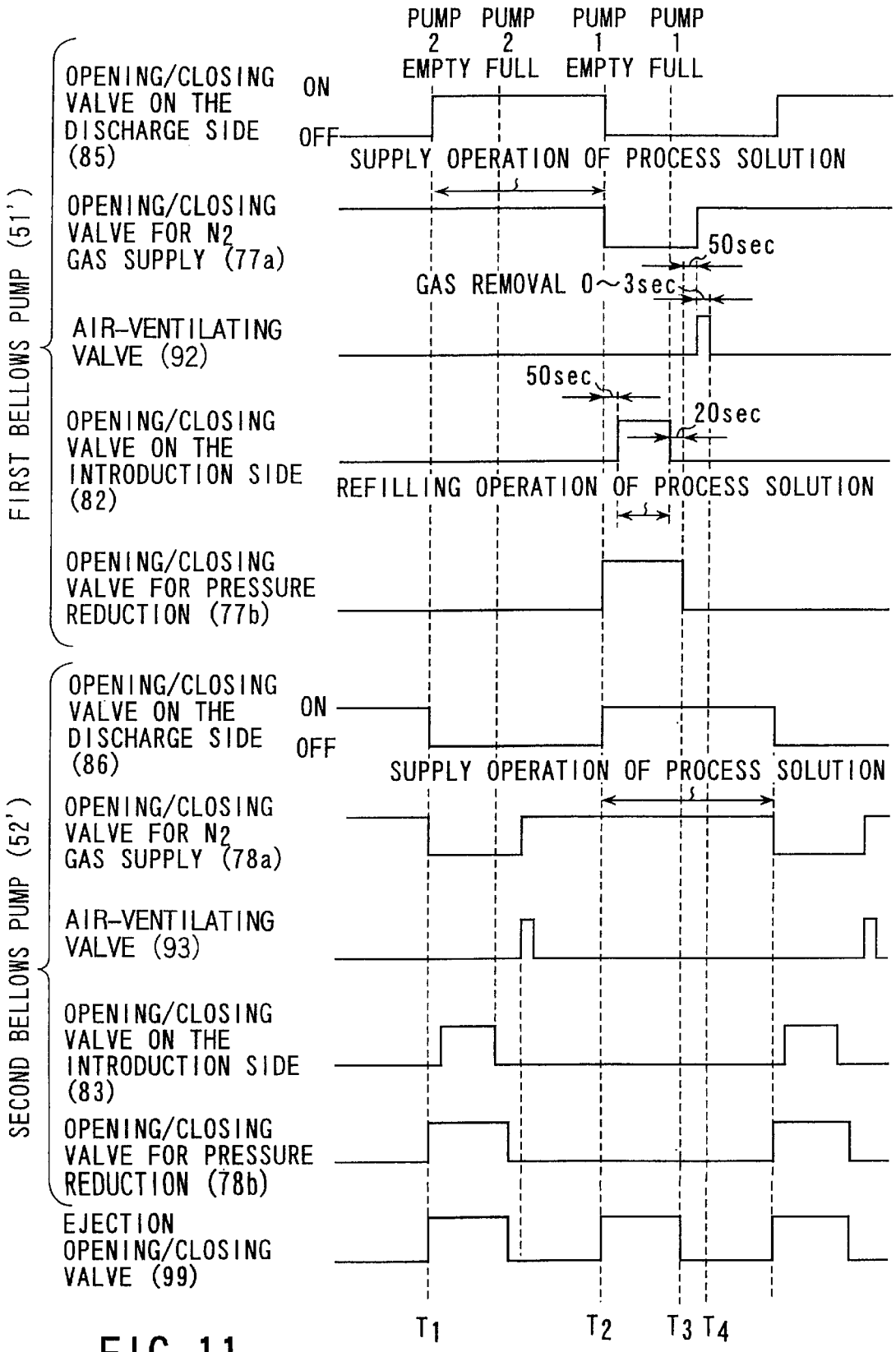
FIG. 11 is a timing chart showing the operation of the second embodiment.

FIG. 11 is a timing chart showing how the system of the embodiment operates. The timing chart of the second embodiment is similar to the timing chart (FIGS. 6 and 7) of the first embodiment, except that the former additionally includes the driving timings at which the $N_2$ gas supply opening/closing valves 77*a* and 78*a,* the pressure-reducing opening/closing valves 77*b* and 78*b* and the ejection opening/closing valve 99 are operated.

The $N_2$ gas supply opening/closing valve 77*a* (78*a*), the pressure-reducing opening/closing valve 77*b* (78*b*) are exclusively controlled, and operate at the same timing as the three-way valve 77 shown in FIG. 6. The driving timings of the ejection opening/closing valve 99 are the timings at which the pressure-reducing opening/closing valves 77*b* and 78*b* are opened.

(Third Embodiment of Present Invention)

The third embodiment of the present invention will now be described.

The third embodiment is featured in that the diaphragm pumps 51" and 52" are employed in place of the first and second syringe pumps 51 and 52 of the first embodiment. Like the syringe pumps 51 and 52 of the first embodiment, the diaphragm pumps 51" and 52" are laid.

Figure 12:
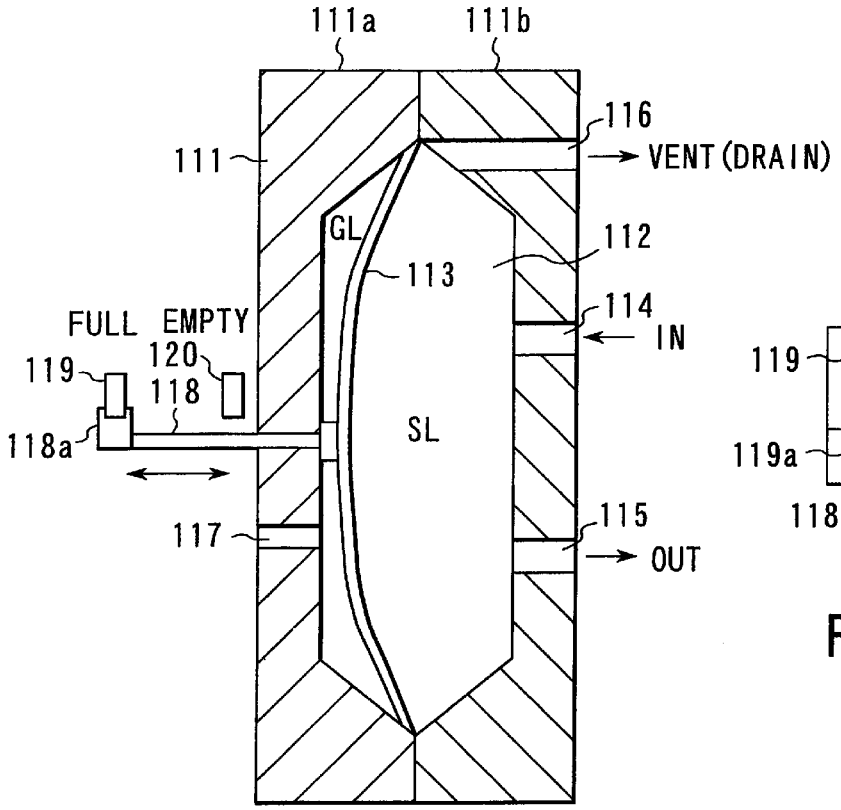
FIG. 12 illustrates the third embodiment of the present invention and is a longitudinal sectional view of the diaphragm pump employed in the embodiment.

The diaphragm pump 51" comprises a diaphragm 113 arranged to have its surfaces extending in the vertical direction; and left and right casings 111*a* and 111*b* for holding the diaphragm by sandwiching the peripheral portions thereof. The internal space defined by the casings 111*a* and 111*b* is partitioned by the diaphragm 113 into two chambers: namely a process solution chamber SL shown on the right side as viewed in FIG. 12 and an $N_2$ gas chamber GL shown on the left side as viewed in FIG. 12.

The right casing 111*b* has a discharge port 115 from which the process solution is discharged, an introduction port 114 from which the process solution is introduced, and a gas-removing port 116 from which bubbles of the $N_2$ gas are discharged. Ports 115, 114 and 116 are located at lower, intermediate and upper levels, respectively. The left casing 11*a* has a gas introduction port 117 from which a gas, i.e., a pressure-providing fluid, is introduced to exert pressure on the diaphragm 113.

Next, a description will be given as to how an empty-state sensor and a full-state sensor are provided for the diaphragm pumps 51" and 52".

A shaft 118 is fixed to the center of the diaphragm 113. The shaft penetrates the left casing 111*a* and is held thereby in such a manner as to be horizontally slidable. Therefore, the shaft 118 is moved horizontally in accordance with a positional change of the diaphragm 113.

Figure 13:
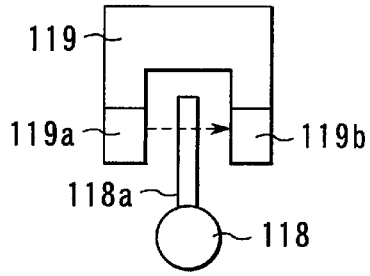
FIG. 13 is a transmission type sensor that is employed in the diaphragm pump shown in FIG. 12 for the detection of a solution amount.

A full-state sensor 119 and an empty-state sensor 120 are arranged in the neighborhood of the projected portion of the shaft 118 in such a manner that they are kept away from the shaft 118 by a certain distance. These sensors are a transmission type, and in the case of sensor 119, it is made up of a light-emitting element 119*a* and a light-receiving element 119*b,* as shown in FIG. 13.

A flag 118*a* is attached the projected end of the shaft 118. The process solution chamber SL is sensed as being full when the flag 118*a* comes to the position facing the full-state sensor 119, and as being empty when it comes to the position facing the empty-state sensor 120.

Figure 14:
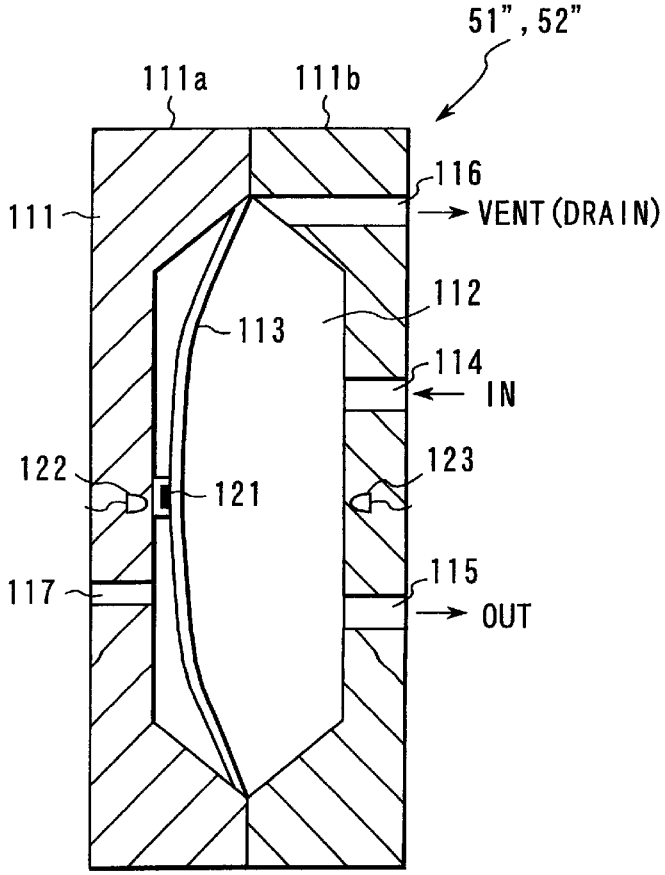
FIG. 14 is a sectional view of a diaphragm pump wherein the solution amount detecting sensor is made of a magnetic sensor.

Instead of the transmission type sensors, a magnetic sensor, such as that shown in FIG. 14, can be employed for the detection of the solution amount. The magnetic sensor shown in FIG. 14 is made up of a magnet or magnetic member 121 attached to the center of the diaphragm 113, a first magnetic switch 122 embedded in the left casing 111*a* and located at the same level as the magnetic member 121, and a second magnetic switch 123 embedded in the right casing 111*b* and located at the same level as the first magnetic member 121.

The process solution chamber SL is sensed as being empty when the magnetic member 121 is detected by the second magnetic switch 123, and as being full when it is detected by the first magnetic switch 122.

Since the diaphragm pump does not comprise a sliding component, such as the piston 63, dust or other undesirable substance is not generated.

The present invention is not limited to the embodiments described above, and can be modified in various manners without departing from the spirit and scope of the invention. For example, the process solution is not limited to a developing solution; it may be thinner or the like.

The substrate processing apparatus was described above, referring to the case where a semiconductor wafer W is treated. Needless to say, the substrate processing apparatus may be employed to treat an LCD glass substrate. In addition, the compressing means is not limited to the examples given above.

Figure 15:
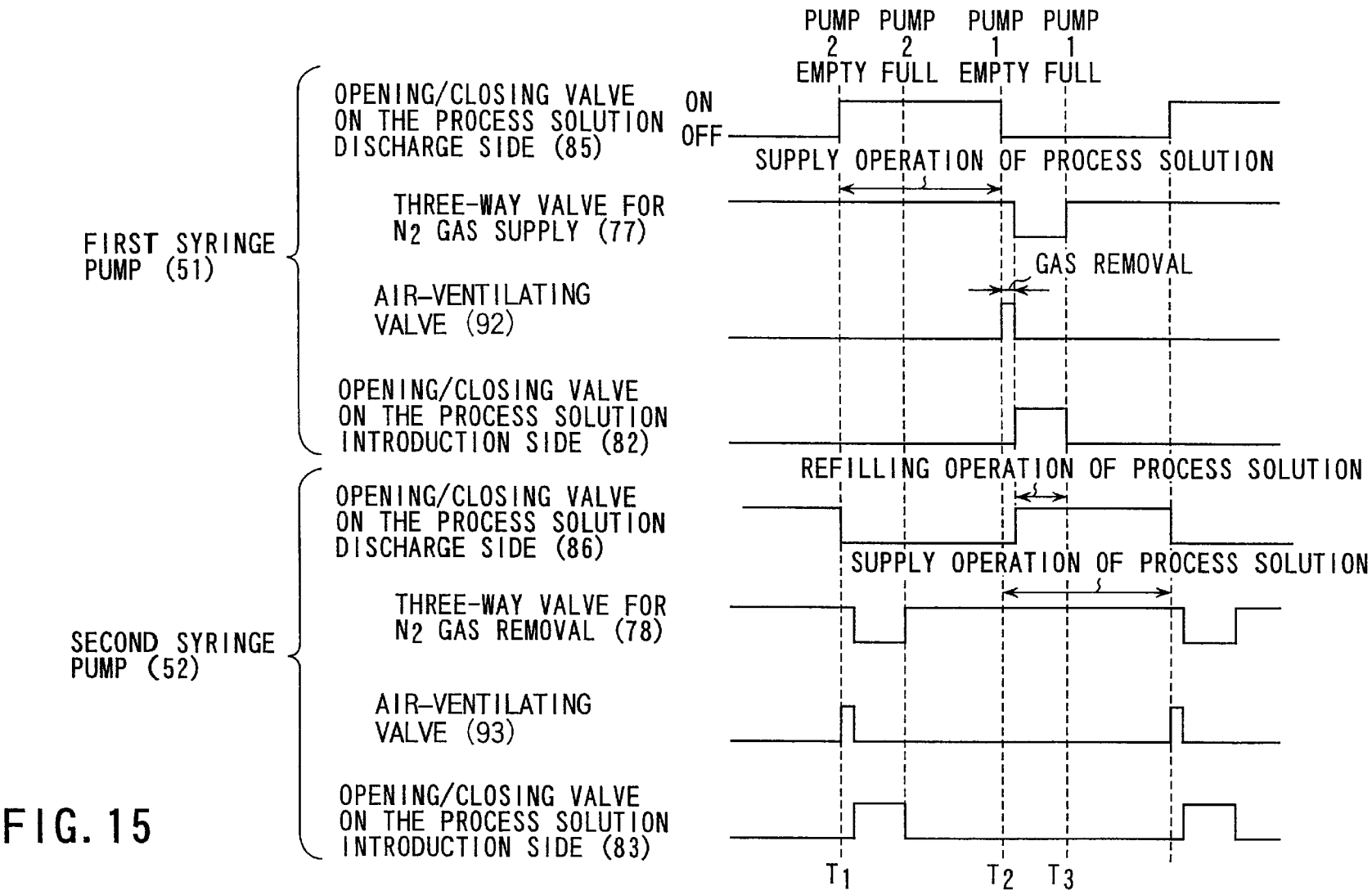
FIG. 15 is a timing chart showing an example of a gas removing timings.

According to the timing chart (FIG. 6) of the first embodiment, the gas-removing valve 92 is operated after time T3 when the refilling operation is started. As shown in the timing chart in FIG. 15, the gas-removing valve 92 may be operated at time T2, at which the supply of the process solution is ended. By so doing, the bubbles left in the process solution at the end of the supply of the process solution can be discharged from the gas discharge port 61, along with the remaining process solution.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A process solution supply system for supplying a process solution to a processing unit for processing a substrate, selected from the group consisting of a semiconductor wafer and an LCD substrate, the system comprising:

a process solution supply source from which the process solution is supplied;

a plurality of intermediate storage mechanisms each for temporarily storing the process solution supplied from the process solution supply source and for supplying the process solution with predetermined pressure applied thereto, wherein each of said intermediate storage mechanisms includes a vessel which has an introduction port and a discharge port for the process solution, and is configured to store the process solution supplied through the introduction port and discharge the process solution to the processing unit, and a compressing member which is arranged inside the vessel to be located between the process solution and a fluid, and is configured to permit pressure of the fluid to act on the process solution;

a fluid supply mechanism for supplying each of the intermediate storage mechanisms with the fluid which serves to actuate the intermediate storage mechanisms;

switching valves for selectively switching flows of the process solution, which is supplied from the process solution supply source to the processing unit through the intermediate storage mechanisms; and a switching valve control device configured to control the switching valves to switch flows of the process solution such that the process solution is continuously supplied to the processing unit.

2. The system according to claim 1, wherein said switching valves include:

an introduction-side switching valve for introducing the process solution into an arbitrary one of the intermediate storage mechanisms; and a discharge-side switching valve for discharging the process solution from the arbitrary one of the intermediate storage mechanisms.

3. The system according to claim 2, wherein said switching valve control device is configured to control the introduction-side and discharge-side switching valves such that when the process solution is being supplied from one of the intermediate storage mechanisms, another one of the intermediate storage mechanisms is refilled with the process solution.

4. The system according to claim 1, further comprising a pressure regulating valve for controlling the pressure of the fluid to be substantially uniform.

5. The system according to claim 1, wherein the vessel of each of the intermediate storage mechanisms is provided with a gas-removing mechanism for removing gas bubbles contained in the process solution.

6. The system according to claim 5, wherein said gas-removing mechanism includes a gas-removing port, formed in the vessel, for discharging the gas bubbles in the process solution from the vessel.

7. The system according to claim 6, wherein said gas-removing port is located at an upper end position of the vessel and discharging gas bubbles staying in an uppermost region inside the vessel.

8. The system according to claim 6, wherein said gas-removing mechanism includes a member configured to form a narrow passage in the introduction port and to reduce the pressure of the process solution, thereby causing gas dissolved in the process solution to bubble.

9. The system according to claim 1, wherein said fluid supply mechanism includes an $N_2$ gas supply mechanism for causing $N_2$ gas to act on the compression member, such that the compression member is moved for supplying the process solution.

10. The system according to claim 1, wherein said fluid supply mechanism includes a pressure-reducing mechanism for removing the fluid from inside the vessel, such that the compression member is moved for a refilling operation.

11. The system according to claim 1, wherein each of said intermediate storage mechanisms comprises a syringe pump including a cylinder serving as the vessel, and a piston serving as the compressing member.

12. The system according to claim 1, wherein each of said intermediate storage mechanisms comprises a bellows pump including an expansible/contractible bellows arranged inside the vessel and containing the process solution.

13. The system according to claim 1, wherein each of said intermediate storage mechanisms comprises a diaphragm pump including a diaphragm serving as the compressing member.

14. A process solution supply system for supplying a process solution to a processing unit for processing a substrate, selected from the group consisting of a semiconductor wafer and an LCD substrate, the system comprising:

a process solution supply source from which the process solution is supplied;

an intermediate storage mechanism for temporarily storing the process solution supplied from the process solution supply source and for supplying the process solution with predetermined pressure applied thereto, wherein said intermediate storage mechanism includes a vessel which has an introduction port and a discharge port for the process solution, and is configured to store the process solution supplied through the introduction port and discharge the process solution to the processing unit, and a compressing member which is arranged inside the vessel to be located between the process solution and a fluid, and is configured to permit pressure of the fluid to act on the process solution;

a fluid supply mechanism for supplying the intermediate storage mechanism with the fluid which serves to actuate the intermediate storage mechanism; and a gas-removing mechanism for removing gas bubbles contained in the process solution, wherein said gas-removing mechanism includes a gas exhaust port, provided for the vessel, for allowing bubbles contained in the process solution to be discharged from the vessel, and a pressure-lowering mechanism arranged at the introduction port of the vessel and configured to lower pressure of the process solution introduced through the introduction port, thereby causing gas dissolved in the process solution to bubble.

15. The system according to claim 14, wherein said pressure-lowering mechanism includes a member that has a thin hole forming a narrow passage in the introduction port to lower the pressure of the process solution by an orifice effect.

16. The system according to claim 14, wherein said intermediate storage mechanism comprises a syringe pump including a cylinder serving as the vessel, and a piston serving as the compressing member.

17. The system according to claim 14, wherein said intermediate storage mechanism comprises a bellows pump including an expansible/contractible bellows arranged inside the vessel and containing the process solution.

18. The system according to claim 14, wherein said intermediate storage mechanism comprises a diaphragm pump including a diaphragm serving as the compressing member.

19. A substrate processing system comprising:

a processing unit for processing a substrate, selected from the group consisting of a semiconductor wafer and an LCD substrate, using a process solution;

a process solution supply source from which the process solution is supplied;

a plurality of intermediate storage mechanisms each for temporarily storing the process solution supplied from the process solution supply source and for supplying the process solution with predetermined pressure applied thereto, wherein each of said intermediate storage mechanisms includes a vessel which has an introduction port and a discharge port for the process solution, and is configured to store the process solution supplied through the introduction port and discharge the process solution to the processing unit, and a compressing member which is arranged inside the vessel to be located between the process solution and a fluid, and is configured to permit pressure of the fluid to act on the process solution;

a fluid supply mechanism for supplying each of the intermediate storage mechanisms with the fluid which serves to actuate the intermediate storage mechanisms;

switching valves for selectively switching flows of the process solution, which is supplied from the process solution supply source to the processing unit through the intermediate storage mechanisms; and a switching valve control device configured to control the switching valves to switch flows of the process solution such that the process solution is continuously supplied to the processing unit.

20. The system according to claim 19, wherein said switching valves include:

an introduction-side switching valve for introducing the process solution into an arbitrary one of the intermediate storage mechanisms; and a discharge-side switching valve for discharging the process solution from the arbitrary one of the intermediate storage mechanism.

21. The system according to claim 20, wherein said switching valve control device is configured to control the introduction-side and discharge-side switching valves such that when the process solution is being supplied from one of the intermediate storage mechanisms, another one of the intermediate storage mechanism is refilled with the process solution.

22. The system according to claim 19, wherein the vessel of each of the intermediate storage mechanisms is provided with a gas-removing mechanism for removing gas bubbles contained in the process solution.

23. The system according to claim 22, wherein said gas-removing mechanism includes a gas-removing port, formed in the vessel, for discharging the gas bubbles in the process solution from the container.

24. The system according to claim 23, wherein said gas-removing mechanism includes a member configured to form a narrow passage in the introduction port and to reduce the pressure of the process solution, thereby causing gas dissolved in the process solution to bubble.

25. A process solution supplying method of supplying a process solution to a processing unit for processing a substrate, selected from the group consisting of a semiconductor wafer and an LCD substrate, wherein said process solution supplied from a process solution supply source is first stored in a plurality of intermediate storage mechanisms and then supplied to the processing unit, the method comprising:

supplying the process solution from a given one of the intermediate storage mechanisms;

refilling another one of the intermediate storage mechanisms with the process solution supplied from the process solution supply source, when the process solution is being supplied from the given intermediate storage mechanism; and starting supply of the process solution from said another one of the intermediate storage mechanisms upon detection of end of the supply of the process solution from the given intermediate storage mechanism, such that the process solution is continuously supplied to the processing unit.

26. The method according to claim 25, wherein each of said intermediate storage mechanism includes:

a vessel which has an introduction port and a discharge port for the process solution, and is configured to store the process solution supplied through the introduction port and discharge the process solution; and a compressing member which is arranged inside the vessel to be located between the process solution and a fluid supplied from a fluid supply mechanism, and is configured to permit pressure of the fluid to act on the process solution.

27. The method according to claim 26, wherein each of said intermediate storage mechanisms comprises a syringe pump including a cylinder serving as the vessel, and a piston serving as the compressing member.

28. The method according to claim 26, wherein each of said intermediate storage mechanisms comprises a bellows pump including an expansible/contractible bellows arranged inside the vessel and containing the process solution.

29. The method according to claim 26, wherein each of said intermediate storage mechanisms comprises a diaphragm pump including a diaphragm serving as the compressing member.

30. The method according to claim 25, further comprising:

exhausting gas bubbles in the process solution from the intermediate storage mechanisms after the intermediate storage mechanisms are refilled with the process solution.

* * * * *